US011187041B2

(12) United States Patent
Riddel et al.

(10) Patent No.: US 11,187,041 B2
(45) Date of Patent: Nov. 30, 2021

(54) SENSOR EQUIPPED DOWNHOLE MOTOR ASSEMBLY AND METHOD

(71) Applicant: National Oilwell Varco, L.P., Houston, TX (US)

(72) Inventors: Jacob D. Riddel, Humble, TX (US); Alamzeb Hafeez Khan, Montgomery, TX (US)

(73) Assignee: National Oilwell Vareo, L.P., Houston, TX (US)

( * ) Notice: Subject to any disclaimer, the term of this patent is extended or adjusted under 35 U.S.C. 154(b) by 73 days.

(21) Appl. No.: 16/509,689

(22) Filed: Jul. 12, 2019

(65) Prior Publication Data

US 2020/0018120 A1 Jan. 16, 2020

Related U.S. Application Data

(60) Provisional application No. 62/697,156, filed on Jul. 12, 2018.

(51) Int. Cl.
*E21B 4/02* (2006.01)
*E21B 21/08* (2006.01)

(52) U.S. Cl.
CPC ..... *E21B 4/02* (2013.01); *E21B 21/08* (2013.01)

(58) Field of Classification Search
CPC ..... E21B 4/00; E21B 21/08; E21B 4/02
See application file for complete search history.

(56) References Cited

U.S. PATENT DOCUMENTS 6,142,228 A * 11/2000 Jogi ..... E21B 4/02 166/250.01
2013/0248247 A1* 9/2013 Sugiura ..... G06F 19/00 175/24
2015/0060141 A1* 3/2015 Leuenberger ..... E21B 44/00 175/40
2015/0167466 A1* 6/2015 Teodorescu ..... G01M 15/14 175/40
2015/0240580 A1 8/2015 Prill et al.
2015/0292280 A1 10/2015 Lewis et al.
2015/0346234 A1 12/2015 Campbell et al.
2020/0018130 A1* 1/2020 Harvey ..... E21B 7/068

FOREIGN PATENT DOCUMENTS

WO 98/16712 A1 4/1998

OTHER PUBLICATIONS

International Search Report and Written Opinion dated Oct. 18, 2019, for Application No. PCT/US2019/041650.

* cited by examiner

*Primary Examiner* — Caroline N Butcher
(74) *Attorney, Agent, or Firm* — Conley Rose, P.C.

(57) ABSTRACT

A downhole motor for drilling a borehole includes a stator assembly including a helical-shaped stator, a rotor assembly rotatably disposed in the stator assembly, wherein the rotor assembly includes a helical-shaped rotor, and a sensor package received in the rotor assembly, wherein the sensor package includes a first pressure sensor, a second pressure sensor, and a plurality of accelerometers.

19 Claims, 6 Drawing Sheets

SENSOR EQUIPPED DOWNHOLE MOTOR ASSEMBLY AND METHOD

CROSS-REFERENCE TO RELATED APPLICATIONS

The present application claims benefit of U.S. provisional patent application No. 62/697,156 filed Jul. 12, 2018, and entitled "Sensor Equipped Downhole Motor Assembly and Method" which is incorporated herein by reference in its entirety.

STATEMENT REGARDING FEDERALLY SPONSORED RESEARCH OR DEVELOPMENT

Not applicable.

BACKGROUND

In drilling a borehole into an earthen formation, such as for the recovery of hydrocarbons or minerals from a subsurface formation, it is typical practice to connect a drill bit onto the lower end of a drillstring formed from a plurality of pipe joints connected together end-to-end, and then rotate the drillstring so that the drill bit progresses downward into the earth to create a borehole along a predetermined trajectory. In addition to pipe joints, the drillstring typically includes heavier tubular members known as drill collars positioned between the pipe joints and the drill bit. The drill collars increase the weight applied to the drill bit to enhance its operational effectiveness. Other accessories commonly incorporated into drillstrings include stabilizers to assist in maintaining the desired direction of the drilled borehole, and reamers to ensure that the drilled borehole is maintained at a desired gauge (i.e., diameter).

In vertical drilling operations, the drillstring and drill bit are typically rotated from the surface with a top dive or rotary table. Drilling fluid or "mud" is typically pumped under pressure down the drillstring, out the face of the drill bit into the borehole, and then up the annulus between the drillstring and the borehole sidewall to the surface. The drilling fluid, which may be water-based or oil-based, is typically viscous to enhance its ability to carry borehole cuttings to the surface. The drilling fluid can perform various other valuable functions, including enhancement of drill bit performance (e.g., by ejection of fluid under pressure through ports in the drill bit, creating mud jets that blast into and weaken the underlying formation in advance of the drill bit), drill bit cooling, and formation of a protective cake on the borehole wall (to stabilize and seal the borehole wall).

In some applications, horizontal and other non-vertical or deviated boreholes are drilled (i.e., "directional drilling") to facilitate greater exposure to and production from larger regions of subsurface hydrocarbon-bearing formations than would be possible using only vertical boreholes. In directional drilling, specialized drillstring components and "bottomhole assemblies" (BHAs) may be used to induce, monitor, and control deviations in the path of the drill bit, so as to produce a borehole of the desired deviated configuration.

Directional drilling may be carried out using a downhole or mud motor provided in the BHA at the lower end of the drillstring immediately above the drill bit. Downhole motors may include several components, such as, for example (in order, starting from the top of the motor): (1) a power section including a stator and a rotor rotatably disposed in the stator; (2) a driveshaft assembly including a driveshaft disposed within a housing, with the upper end of the driveshaft being coupled to the lower end of the rotor; and (3) a bearing assembly positioned between the driveshaft assembly and the drill bit for supporting radial and thrust loads. For directional drilling applications, the motor may include a bent housing to provide an angle of deflection between the drill bit and the BHA. In at least some applications, performance curves for the downhole motor, including output speed and torque as a function of differential operating pressure, may be estimated beforehand via a lab-based static motor dynamometer. The performance curves estimated by the motor dynamometer may be used for configuring the geometry of the downhole motor and for selecting the operational parameters for the downhole motor.

SUMMARY

An embodiment of a downhole motor for drilling a borehole comprises a stator assembly comprising a helical-shaped stator, a rotor assembly rotatably disposed in the stator assembly, wherein the rotor assembly comprises a helical-shaped rotor, and a sensor package received in the rotor assembly, wherein the sensor package comprises a first pressure sensor, a second pressure sensor, and a plurality of accelerometers. In some embodiments, the rotor comprises a central passage extending between a first end of the rotor and a second end of the rotor. In some embodiments, a first passage is formed in the stator housing adjacent a first end of the rotor of the rotor assembly, a second passage is formed in the stator housing adjacent a second end of the rotor opposite the first end, and the first pressure sensor is in fluid communication with the first passage and the second pressure sensor is in fluid communication with the second passage. In certain embodiments, the sensor package comprises a gyroscope and a sensor housing that receives the first pressure sensor, second pressure sensor, the plurality of accelerometers, and the gyroscope. In certain embodiments, the rotor assembly comprises a rotor catch coupled to an end of the rotor, and wherein the sensor package is received in a receptacle of the rotor catch. In some embodiments, the rotor catch comprises a central passage extending between opposite ends of the rotor catch, and wherein the central passage of the rotor catch is in fluid communication with the first passage of the stator assembly. In some embodiments, the plurality of accelerometers comprises a first accelerometer configured to measure acceleration along a first axis and a second accelerometer configured to measure acceleration along a second axis extending orthogonal from the first axis. In certain embodiments, the sensor package comprises a processor configured to estimate a rotational speed of the rotor assembly relative to the stator assembly based on measurements provided by the plurality of accelerometers.

An embodiment of a drilling system for forming a borehole comprises a downhole motor comprising a stator assembly comprising a helical-shaped stator, a rotor assembly rotatably disposed in the stator assembly, wherein the rotor assembly comprises a helical-shaped rotor, and a sensor package comprising a plurality of accelerometers, wherein the plurality of accelerometers are each disposed in a sensor housing of the sensor package, a processor configured to estimate a rotational speed of the rotor assembly relative to the stator assembly based on measurements provided by the plurality of accelerometers. In some embodiments, the sensor package comprises a first pressure sensor and a second pressure sensor. In some embodiments, the processor is configured to estimate a power output of the downhole motor based on measurements provided by the first and second pressure sensors, the plurality of accelerometers, and a gyroscope of the sensor package. In certain embodiments, the rotor comprises a central passage extending between a first end of the rotor and a second end of the rotor. In certain embodiments, the stator housing comprises a first passage adjacent a first end of the rotor of the rotor assembly and a second passage adjacent a second end of the rotor opposite the first end, and the first pressure sensor is in fluid communication with the first passage and the second pressure sensor is in fluid communication with the second passage. In some embodiments, the rotor assembly comprises a rotor catch coupled to an end of the rotor, and wherein the sensor package is received in a receptacle of the rotor catch. In some embodiments, the rotor catch comprises a central passage extending between opposite ends of the rotor catch, and wherein the central passage of the rotor catch is in fluid communication with the first passage of the stator assembly. In certain embodiments, the processor is configured to estimate a whirl rate of the rotor assembly based on measurements provided by the plurality of accelerometers.

An embodiment of a method for forming a borehole comprises (a) pumping fluid through a drillstring to a downhole motor coupled to the drillstring, (b) rotating a rotor assembly of the downhole motor relative to a stator assembly of the downhole motor in response to (a), and (c) measuring a rotational speed of the rotor assembly relative to the stator assembly using a sensor package received in the rotor assembly. In some embodiments, the method further comprises (d) measuring differential fluid pressure across opposite ends of a helical-shaped rotor of the rotor assembly using the sensor package, and (e) measuring a power output of the downhole motor using the sensor package. In some embodiments, the method further comprises (d) communicating fluid upstream of the rotor assembly to a first pressure sensor of the sensor package, and (e) communicating fluid downstream of the rotor assembly through a central passage formed in a helical-shaped rotor of the rotor assembly to a second pressure sensor of the sensor package. In some embodiments, the method further comprises (d) estimating a whirl rate of the rotor assembly based on measurements provided by a plurality of accelerometers and a gyroscope of the sensor package.

BRIEF DESCRIPTION OF THE DRAWINGS

For a detailed description of disclosed embodiments, reference will now be made to the accompanying drawings in which.

DETAILED DESCRIPTION OF DISCLOSED EXEMPLARY EMBODIMENTS

Figure 1:
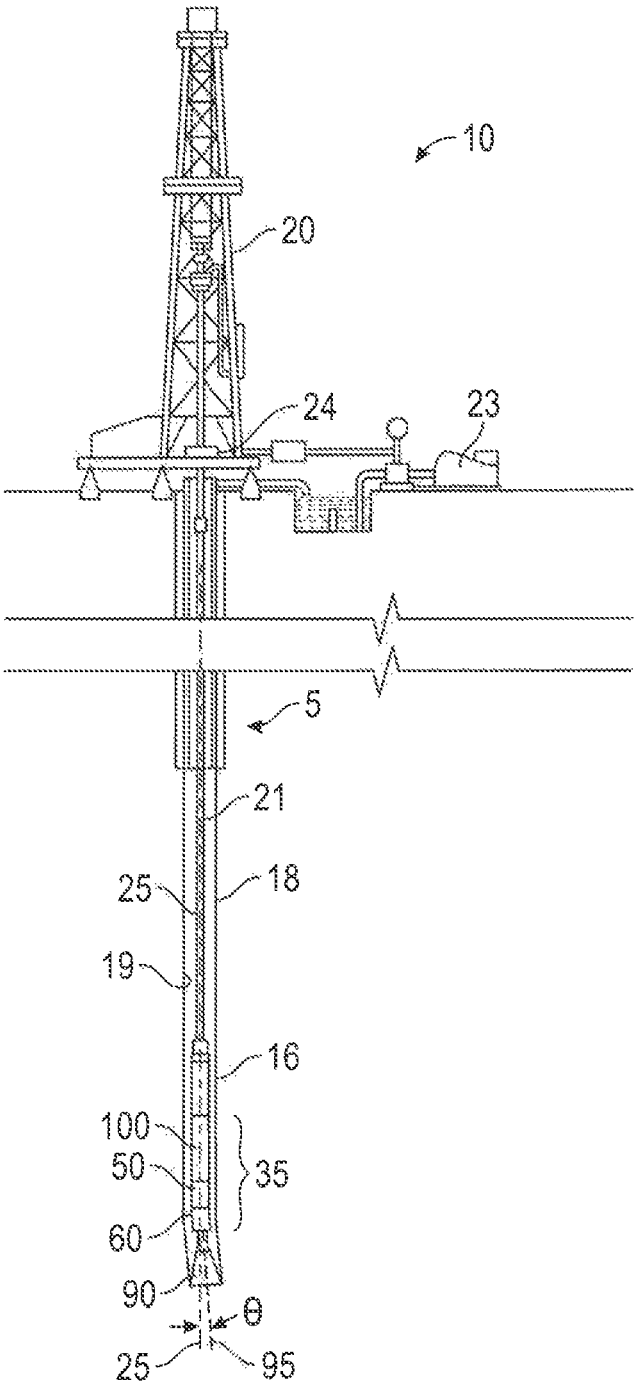
FIG. 1 is a schematic partial cross-sectional view of a well system including an embodiment of a downhole mud motor in accordance with principles disclosed herein.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring to FIG. 1, an embodiment of a well or drilling system 10 is shown. Well system 10 is generally configured for drilling a borehole 16 in an earthen formation 5. In the embodiment of FIG. 1, well system 10 includes a drilling rig 20 disposed at the surface, a drillstring 21 extending downhole from rig 20, a bottomhole assembly (BHA) 30 coupled to the lower end of drillstring 21, and a drill bit 90 attached to the lower end of BHA 30. A surface or mud pump 23 is positioned at the surface and pumps drilling fluid or mud through drillstring 21. Additionally, rig 20 includes a rotary system 24 for imparting torque to an upper end of drillstring 21 to thereby rotate drillstring 21 in borehole 16. In this embodiment, rotary system 24 comprises a rotary table located at a rig floor of rig 20; however, in other embodiments, rotary system 24 may comprise other systems for imparting rotary motion to drillstring 21, such as a top drive. A downhole mud motor 35 is provided in BHA 30 for facilitating the drilling of deviated portions of borehole 16. Moving downward along BHA 30, motor 35 includes a hydraulic drive or power section 100, a driveshaft assembly 50, and a bearing assembly 60. In some embodiments, the portion of BHA 30 disposed between drillstring 21 and motor 35 can include other components, such as drill collars, measurement-while-drilling (MWD) tools, reamers, stabilizers and the like.

Figure 2:
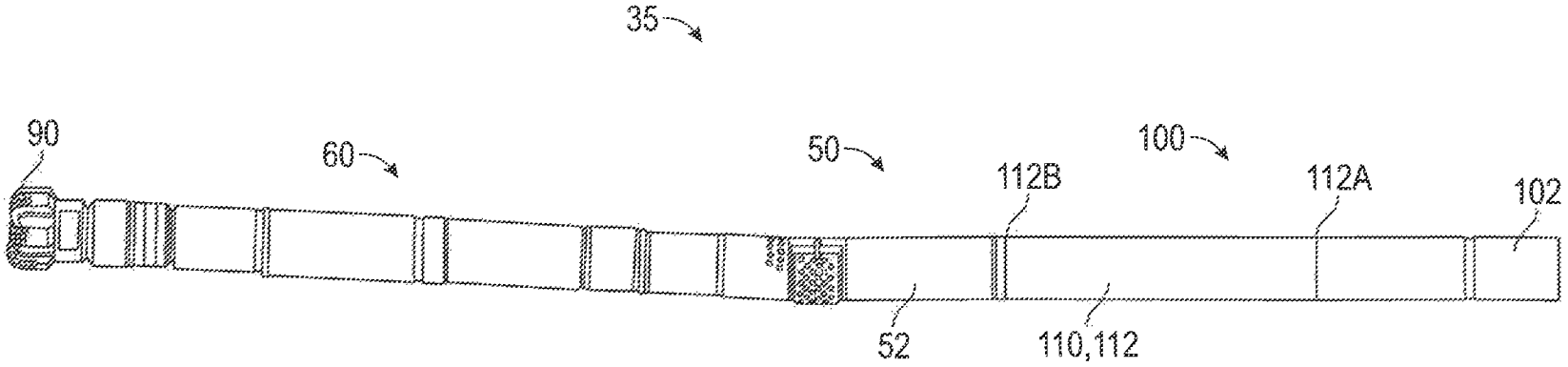
FIG. 2 is a side view of the downhole mud motor of FIG. 1.

Referring to FIGS. 1, 2, an embodiment of the downhole motor 35 of the BHA 30 of FIG. 1 is shown in FIG. 2. Power section 100 of downhole motor 35 converts the fluid pressure of the drilling fluid pumped downward through drillstring 21 into rotational torque for driving the rotation of drill bit 90. Driveshaft assembly 50 and bearing assembly 60 transfer the torque generated in power section 100 to bit 90. With force or weight applied to the drill bit 90, also referred to as weight-on-bit ("WOB"), the rotating drill bit 90 engages the earthen formation and proceeds to form borehole 16 along a predetermined path toward a target zone.

The drilling fluid or mud pumped down the drillstring 21 and through BHA 30 passes out of the face of drill bit 90 and back up the annulus 18 formed between drillstring 21 and the wall 19 of borehole 16. The drilling fluid cools the bit 90, and flushes the cuttings away from the face of bit 90 and carries the cuttings to the surface.

Figure 3:
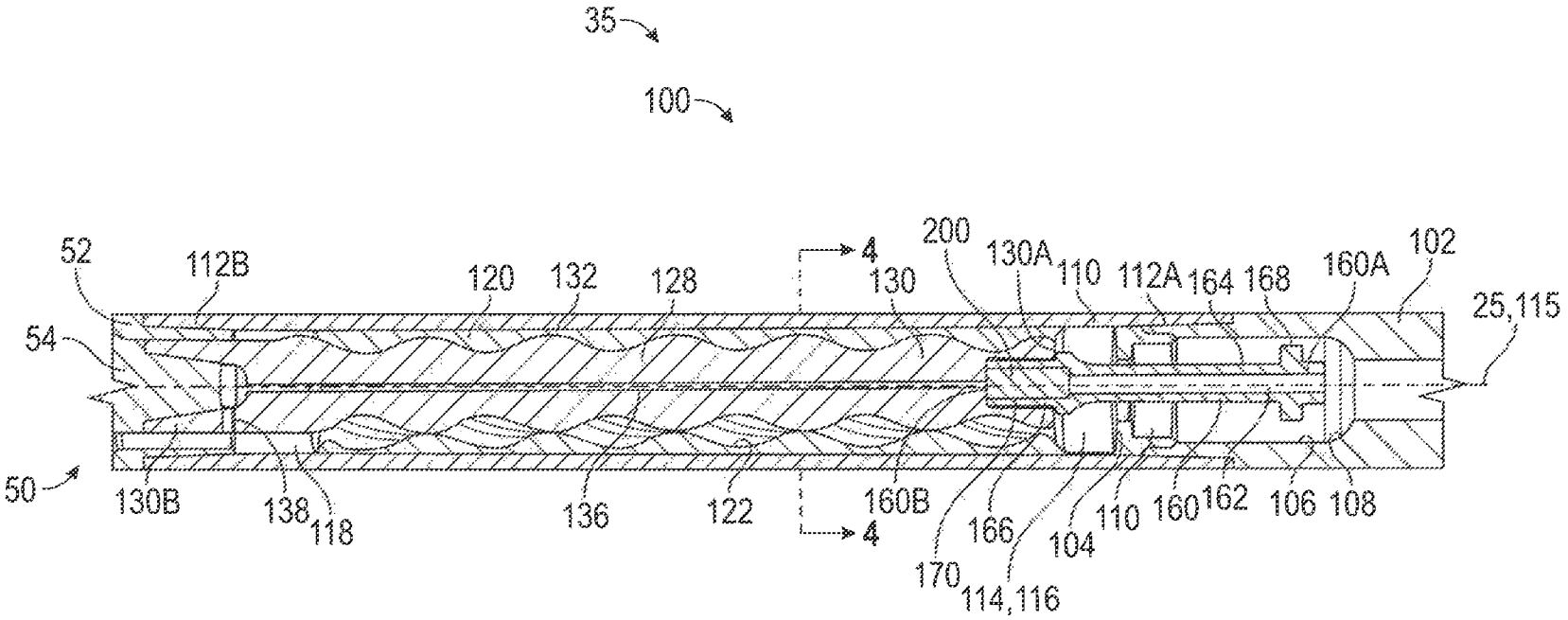
FIG. 3 is a side cross-sectional view of an embodiment of a power section of the downhole mud motor of FIG. 1 in accordance with principles disclosed herein.
Figure 4:
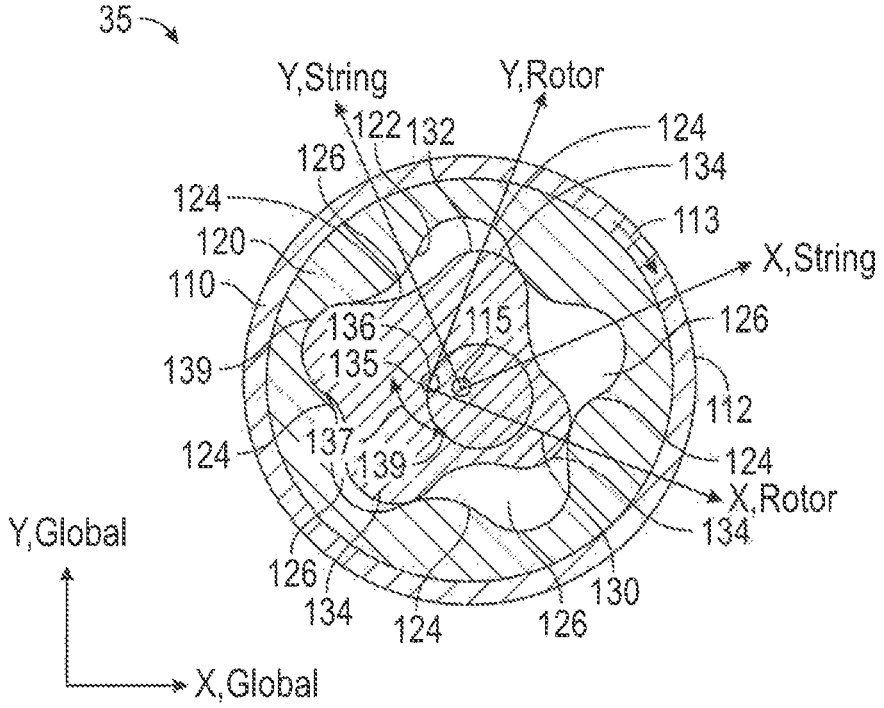
FIG. 4 is a cross-sectional view along lines 4-4 of FIG. 3 of the power section of FIG. 3.
Figure 5:
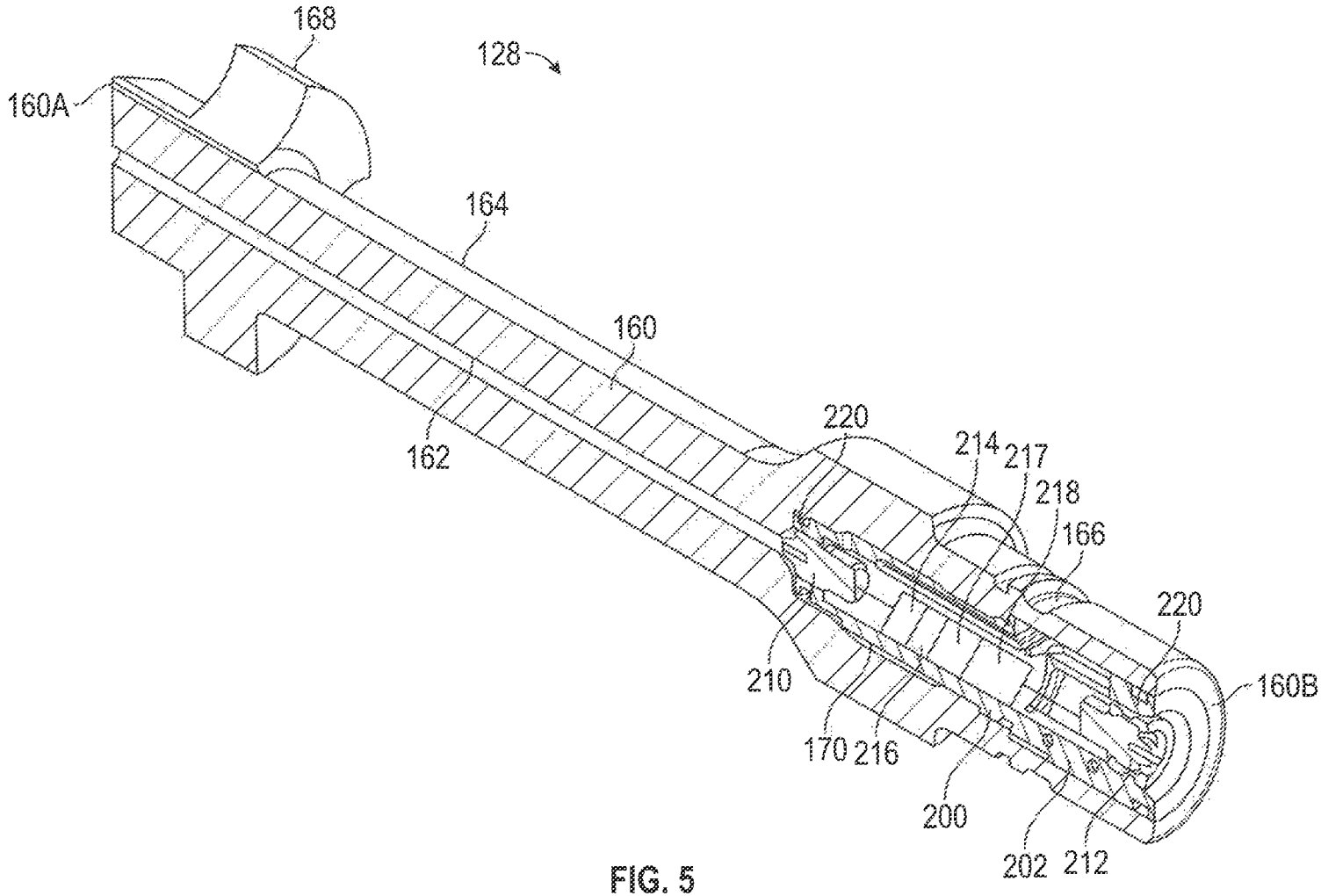
FIG. 5 is a perspective view of an embodiment of a sensor package of the power section of FIG. 3 in accordance with principles disclosed herein.
Figure 6:
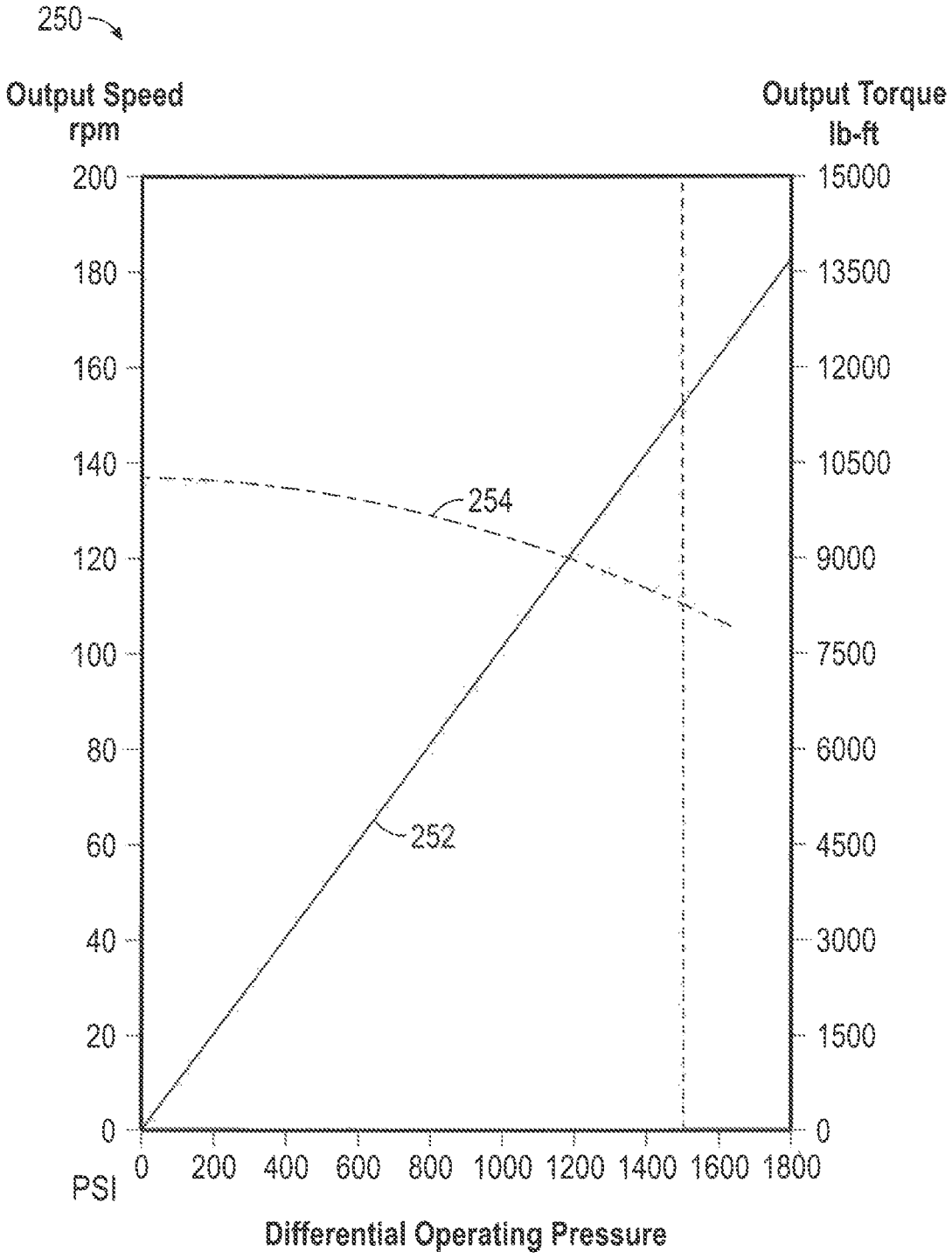
FIG. 6 is a graph illustrating embodiments of performance curves of the power section of FIG. 3 in accordance with principles disclosed herein.

Referring to FIGS. 1-5, an embodiment of the power section 100 of the mud motor shown in FIG. 2 is shown in FIGS. 3-5. In the embodiment of FIGS. 1-5, power section 100 generally includes an upper sub 102, a stator assembly 110 releasably coupled to upper sub 102, and a rotor assembly 128 including a helical-shaped rotor 130 rotatably disposed in stator assembly 110, and a motor or rotor catch 160 coupled to rotor 130. Upper sub 102 includes a first or upper end, a second or lower end 104, and a central bore or passage defined by a generally cylindrical inner surface 106 that extends between opposite ends of upper sub 102. In this embodiment, the inner surface 106 of upper sub 102 includes an annular first or upper shoulder 106, and an annular second or lower shoulder 108 positioned at the lower end 104 of upper sub 102.

In this embodiment, stator assembly 110 of power section 100 has a central or longitudinal axis 115 and generally includes a stator housing 112 lined with a helical-shaped elastomeric stator insert or stator 120. Stator housing 112 includes a first or upper end 112A releasably coupled to the lower end 104 of upper sub 102, a second or lower end 112B releasably coupled to a driveshaft housing 52 of the driveshaft assembly 50, and a bore or central passage 114 extending between ends 112A, 112B. Stator insert 120 of stator assembly includes an inner surface 122 extending between opposite ends of stator insert 120 that defines a set of stator lobes 124 (shown in FIG. 4). In this configuration, central passage 114 of stator housing 112 comprises a passage 116 positioned above or upstream from stator insert 120 and a passage 118 positioned below or downstream from stator insert 120. Although in this embodiment stator assembly 110 includes a stator housing 112 with a separate stator insert 120 lined thereon, in other embodiments, stator assembly 110 may comprise a single monolithically formed body defining a helical-shaped inner surface.

In this embodiment, rotor 130 of the rotor assembly 128 of power section 100 has a central or longitudinal axis 135 (shown in FIG. 4) and generally includes a first or upper end 130A coupled with rotor catch 160, and a second or lower end 130B opposite upper end 130A that is releasably coupled with a driveshaft adapter 54 of driveshaft assembly 50. Driveshaft adapter 54 couples with a driveshaft (not shown) of driveshaft assembly 50 for rotating drill bit 90. Rotor 130 also includes an outer surface 132 extending between ends 130A, 130B, that defines a set of rotor lobes 134 (shown in FIG. 4) that intermesh with the set of stator lobes 124 defined by stator insert 120. Rotor 130 further includes a central bore or passage 136 extending between ends 130A, 130B. In this embodiment, a radial port 138 is positioned in rotor 130 proximal lower end 130B, where radial port 138 is in fluid communication with both passage 136 of rotor 130 and the downstream passage 118 of stator housing 112.

As shown particularly in FIG. 4, the rotor 130 of power section 100 has one fewer lobe 134 than stator insert 120. When the rotor 130 and the stator assembly 110 are assembled, a series of cavities 126 are formed between the outer surface 132 of the rotor 130 and the inner surface 122 of the stator insert 120. Each cavity 126 is sealed from adjacent cavities 126 by seals formed along the contact lines between the rotor 130 and the stator insert 120. As will be described further herein, the central axis 135 of the rotor 130 is radially offset from the central axis 115 of the stator insert 120 by a fixed value known as the "eccentricity" of the rotor-stator assembly. Consequently, rotor 130 may be described as rotating eccentrically within stator insert 120. During operation of the power section 100, fluid is pumped under pressure into one end of the power section 100 where it fills a first set of open cavities 126. A pressure differential across the adjacent cavities 126 forces the rotor 130 to rotate relative to the stator insert 120. As the rotor 130 rotates inside the stator insert 120, adjacent cavities 126 are opened and filled with fluid. As this rotation and filling process repeats in a continuous manner, the fluid flows progressively down the length of power section 100 and continues to drive the rotation of the rotor 130. In this arrangement, the rotational motion and torque of rotor 130 is transferred to drill bit 90 via driveshaft assembly 50 and bearing assembly 60.

Rotor catch 160 of the rotor assembly 128 of power section 100 is generally configured to prevent rotor 130 from becoming separated from stator insert 120 during the operation of power section 100. As used herein, the term "rotor catch" means and includes any mechanism coupled to a rotor (e.g., rotor 130) that prevents from completing separating or decoupling from a corresponding stator or stator insert (e.g., stator insert 120), including motor catches. In this embodiment, rotor catch 160 generally includes a first or upper end 160A, a second or lower end 160B opposite upper end 160A that is releasably coupled to the upper end of rotor 130, a central passage 162 extending between ends 160A, 160B, and a generally cylindrical outer surface 164 extending between ends 160A, 160B. The outer surface 164 of rotor catch 160 includes an annular seal 166 proximal lower end 160B that sealingly engages an inner surface defining the central passage 166 of rotor 130. Additionally, outer surface 164 includes an annular shoulder or catch 168 proximal upper end 160A that projects radially outwards therefrom. Catch 168 includes an outer diameter that is greater in size than an inner diameter of both upper shoulder 108 and lower shoulder 110 of the upper sub 102, thereby preventing catch 168 from exiting the central passage of upper sub 102. In this manner, rotor 130, which is coupled to rotor catch 160, is prevented from becoming disconnected from stator insert 120 of stator assembly 110.

In this embodiment, the central passage 162 of rotor catch 160 includes a space or receptacle 166 proximal lower end 160B that houses a sensor package 200 therein. As shown particularly in FIG. 5, in this embodiment, sensor package 200 generally includes a sensor housing 202, a first or upper pressure sensor 210 positioned at an upper end of sensor housing 202, a second or lower pressure sensor 212 positioned at a lower end of sensor housing 202, a gyroscope 214, a plurality of accelerometers 216, a processor 217, and a data storage medium 218, where processor 217 and data storage medium 218 are in signal communication with sensors 210, 212, 214, and 216. Additionally, a pair of annular seals 220 are positioned radially between an outer surface of sensor housing 202 and an inner surface of the receptacle 170 of rotor catch 160. Although in this embodiment sensor package 200 is positioned in rotor catch 160, in other embodiments, sensor package 200 may be positioned at a number of various locations in rotor 130.

Upper pressure sensor 210 of sensor package 200 is in fluid communication with central passage 162 of rotor catch 160, and thus, is positioned to measure fluid pressure in the upstream passage 116 of stator assembly 110. Lower pressure sensor 212 of sensor package 200 is in fluid communication with the central passage 136 of rotor 130, and thus, is positioned to measure fluid pressure in the downstream passage 118 of stator assembly 110. In this manner, the differential pressure (ΔP) between the upstream or low pressure side and the downstream or high pressure side of power section 100 may be determined by determining the differential between the measurements performed by pressure sensors 210, 212.

Gyroscope 214 of sensor package 200 is generally configured for measuring the rotational speed of rotor catch 160 and rotor 130, which is rotationally locked to rotor catch 160. Particularly, gyroscope 214 measures the global rotational speed ($\omega_{Rotor,\ global}$) of rotor 130 with respect to a global coordinate system (indicated by the "$X_{,\ global}$" and "$Y_{,\ global}$" axes of the global coordinate system in FIG. 4) fixed to the earthen formation 5. Particularly, during operation of well system 10, stator assembly 110 is rotated (indicated by arrow 113 in FIG. 4) from the surface by rotary table 24 in a first rotational direction and at a rotational speed $\omega_{String,\ global}$. Additionally, the fluid pumped through power section 100 from mud pump 23 forces rotor 130 to rotate relative (indicated by arrow 137 in FIG. 4) to stator assembly 110 and drillstring 21 in the first rotational direction at a rotational speed $\omega_{Rotor,\ string}$. In other words, rotational speed $\omega_{Rotor,\ string}$ of rotor 130 is measured with respect to a coordinate system that rotates at the same rate as stator assembly 110 and drillstring 21 (indicated by the "$X_{,\ string}$" and "$Y_{,\ string}$" axes of the local coordinate system of stator assembly 110 and drillstring 21 in FIG. 4). Thus, the rotational speed $\omega_{Rotor,\ global}$ of rotor 130 measured by gyroscope 214 is equal to the sum of the rotational speeds $\omega_{String,\ global}$ and $\omega_{Rotor,\ string}$.

Further, the central axis 135 of rotor 130 travels along an eccentric path (indicated by arrow 139 in FIG. 4) extending about the central axis 115 of stator assembly 110 in a backwards whirling motion. In other words, rotor 130 travels along the eccentric path 139 in a second rotational direction opposite the first rotational direction. In this embodiment, accelerometers 216 are positioned at or near central axis 135 of rotor 130 within housing 202 of sensor package 20 and are configured to measure accelerations along X and Y axes of a local coordinate system of the rotor 130 (indicated by the "$X_{,\ rotor}$" and "$Y_{,\ rotor}$" axes of the local coordinate system of rotor 130 in FIG. 4). In this embodiment, a phase unwrapping method may be used to compute the global eccentric or whirl rate $\omega_{e,\ global}$ of rotor 130 respective the global coordinate system indicated by the "$X_{,\ global}$" and "$Y_{,\ global}$" axes, where $\omega_{e,\ global}$ is equal to the derivative or slope of the phase angle θ. Not intending to be bound by any theory, under the phase unwrapping method, phase angle θ is equal to the arctangent of the measured acceleration along the Y axis over time divided by the measured acceleration along the X axis over time ($\arctan(a_y(t)/a_x(t))$). Additionally, $\omega_{e,\ global}$ may also be expressed in as in equation (1) below where $\omega_{e,\ global}$ is equal to the eccentric or Whirl rate of rotor 130 relative to the local coordinate system of stator assembly 110 and drillstring 21:

$$\omega_{e,string} = -N_{lobes} * \omega_{Rotor,string} \quad (1)$$

Equation (1) may be rearranged to yield the rotational rate $W_{Rotor,\ string}$ of rotor 130 relative to stator assembly 110 and drillstring 21 as indicated below in equation (2), where $N_{lobes}$ is equal to the number of rotor lobes 134:

$$\omega_{Rotor,string} = \frac{\omega_{Rotor,global} - \omega_{e,global}}{N_{lobes}} \quad (2)$$

Given that the number of rotor lobes 134 of rotor 130 is known, the rotational rate $\omega_{Rotor,\ string}$ of rotor 130 relative to stator assembly 110 and drillstring 21 may be computed from the global rotational rate $\omega_{Rotor,\ global}$ of rotor 130 measured by gyroscope 214 and the global whirl rate $\omega_{e,\ global}$ of rotor 130 computed from the accelerations measured by accelerometers 216 using the phase unwrapping method, as described above. Additionally, the eccentric or whirl rate $\omega_{e,\ rotor}$ of rotor 130 in the local coordinate system of rotor 130 may be computed by subtracting the computed global whirl rate $\omega_{e,\ global}$ from the global rotational speed $\omega_{Rotor,\ global}$ of the rotor 130. In this embodiment, the computation of global whirl rate $\omega_{e,\ global}$ and the rotational speed $\omega_{Rotor,\ string}$ of rotor 130 relative to stator assembly 110 is computed by processor 217 while power section 100 is disposed in borehole 16; however, in other embodiments, $\omega_{e,\ global}$ and/or $\omega_{Rotor,\ string}$ may be computed at the surface using an external processor from the measurements of gyroscope 214 and accelerometers 216 recorded on data storage medium 218.

Referring to FIGS. 1-6, performance curves 252, 254 of power section 100 (illustrated on graph 250 in FIG. 6) may be estimated using the rotational rate $\omega_{Rotor,\ string}$ of rotor 130 relative to stator assembly 110 computed from the data collected from gyroscope 216 and accelerometers 216, and from the differential pressure ΔP computed from the measurements collected from pressure sensors 210, 212. Particularly, performance curve 252 comprises a torque curve 252 that provides an estimated output torque (indicated on the right-side Y axis of graph 250) of power section 100 at a given differential pressure ΔP measured by pressure sensors 210, 212.

Additionally, performance curve 254 comprises an output speed curve 254 that provides an estimated output speed of rotor 130 corresponding to the rotational rate $\omega_{Rotor,\ string}$ of rotor 130 at a given fluid flow rate supplied to power section 100 from mud pump 23. Further, the power output $P_{hyd}$ of power section 100 at a given instant in time may be estimated by multiplying the estimated output speed of rotor 130 by the estimated output torque. In this embodiment, performance curves 252, 254 are computed by processor 217 of sensor package 200 at the same time; however, in other embodiments, performance curves 252, 254 may be recorded at the surface using an external processor from the measurements of gyroscope 214 and accelerometers 216 recorded on data storage medium 218. In further embodiments, measurements performed by gyroscope 214 and accelerometers 216 may be transmitted in real-time uphole to the rig 20 via a downhole communications network, such as a system of wired drill pipe (WDP) joints forming drillstring 21.

As described above, sensor package 200 is configured to estimate power output $P_{hyd}$ of power section 100 based on the estimated output speed of rotor 130 and the estimated output torque of power section 100. In the manner described above, the power output $P_{hyd}$ of power section 100 is estimated under actual downhole conditions with power section 100 disposed in borehole 16, which may provide a more accurate estimation of power output $P_{hyd}$ than what may be achieved via a lab-based static motor dynamometer where power section 100 is not subjected to the same conditions experienced in borehole 16. Additionally, by measuring the downhole conditions experienced by power section 100, the effect of particular downhole conditions (e.g., pressure, temperature, characteristics of the fluid pumped into power section 100 from mud pump 23, characteristics of formation 5, etc.) on the performance of power section 100 may be analyzed and thereby used to inform the preferred operational parameters for power section 100. Further, sensor package 200 may be used to monitor the performance characteristics of power section 100 over time to thereby monitor the wear accrued by power section 100 as the performance of power section 100 declines over time.

As described above, housing 202 of sensor package 200 is sealed from the surrounding environment via seals 220, and thus, only pressure sensors 210, 212 are exposed to the fluid provided to power section 100 from mud pump 23. The shielding provided by housing 202 to the electrical components of sensor package 200 may enhance the reliability of sensor package 200 in at least some applications. Additionally, sensor package 200 is received entirely within rotor catch 160 (or rotor 130 in other embodiments), and thus, is not located in both rotor catch 160/rotor 130 and stator assembly 110, eliminating the need to communicate signals and/or data radially between rotor catch 160/rotor 130 and stator assembly 110, and potentially reducing the complexity and cost while increasing the reliability of sensor package 200.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A downhole motor for drilling a borehole, comprising:
a stator assembly comprising a helical-shaped stator;
a rotor assembly rotatably disposed in the stator assembly, wherein the rotor assembly comprises a helical-shaped rotor;
a sensor package received in the rotor assembly, wherein the sensor package comprises a first pressure sensor, a second pressure sensor, and a plurality of accelerometers; and
a processor configured to estimate a rotational speed of the rotor assembly based on a whirl rate of the helical-shaped rotor determined from measurements provided by the plurality of accelerometers, and wherein the processor is configured to estimate a rotational speed of the rotor assembly relative to a non-zero rotational speed of the stator assembly based on measurements provided by the plurality of accelerometers.

2. The downhole motor of claim 1, wherein the rotor comprises a central passage extending between a first end of the rotor and a second end of the rotor.

3. The downhole motor of claim 2, wherein:
a first passage is formed in a stator housing of the stator assembly adjacent a first end of the rotor of the rotor assembly;
a second passage is formed in the stator housing adjacent a second end of the rotor opposite the first end; and
the first pressure sensor is in fluid communication with the first passage and the second pressure sensor is in fluid communication with the second passage.

4. The downhole motor of claim 3, wherein the sensor package comprises a gyroscope and a sensor housing that receives the first pressure sensor, second pressure sensor, the plurality of accelerometers, and the gyroscope.

5. The downhole motor of claim 4, wherein the rotor assembly comprises a rotor catch coupled to an end of the rotor, and wherein the sensor package is received in a receptacle of the rotor catch.

6. The downhole motor of claim 5, wherein the rotor catch comprises a central passage extending between opposite ends of the rotor catch, and wherein the central passage of the rotor catch is in fluid communication with the first passage of the stator assembly.

7. The downhole motor of claim 1, wherein the plurality of accelerometers comprises a first accelerometer configured to measure acceleration along a first axis and a second accelerometer configured to measure acceleration along a second axis extending orthogonal from the first axis.

8. A drilling system for forming a borehole, comprising:
a downhole motor comprising:
a stator assembly comprising a helical-shaped stator;
a rotor assembly rotatably disposed in the stator assembly, wherein the rotor assembly comprises a helical-shaped rotor; and
a sensor package comprising a plurality of accelerometers, wherein the plurality of accelerometers are each disposed in a sensor housing of the sensor package and coupled to the rotor assembly such that relative rotation between the plurality of accelerometers and the helical-shaped rotor is restricted;
a processor configured to estimate a rotational speed of the rotor assembly relative to a non-zero rotational speed of the stator assembly based on measurements provided by the plurality of accelerometers.

9. The drilling system of claim 8, wherein the sensor package comprises a first pressure sensor and a second pressure sensor.

10. The drilling system of claim 9, wherein the processor is configured to estimate a power output of the downhole motor based on measurements provided by the first and second pressure sensors, the plurality of accelerometers, and a gyroscope of the sensor package.

11. The drilling system of claim 9, wherein the rotor comprises a central passage extending between a first end of the rotor and a second end of the rotor.

12. The drilling system of claim 11, wherein:
a stator housing of the stator assembly comprises a first passage adjacent a first end of the rotor of the rotor assembly and a second passage adjacent a second end of the rotor opposite the first end; and
the first pressure sensor is in fluid communication with the first passage and the second pressure sensor is in fluid communication with the second passage.

13. The drilling system of claim 12, wherein the rotor assembly comprises a rotor catch coupled to an end of the rotor, and wherein the sensor package is received in a receptacle of the rotor catch.

14. The drilling system of claim 13, wherein the rotor catch comprises a central passage extending between opposite ends of the rotor catch, and wherein the central passage of the rotor catch is in fluid communication with the first passage of the stator assembly.

15. The drilling system of claim 8, wherein the processor is configured to estimate a whirl rate of the rotor assembly based on measurements provided by the plurality of accelerometers.

16. A method for forming a borehole, comprising:

(a) pumping fluid through a drillstring to a downhole motor coupled to the drillstring;

(b) rotating a rotor assembly of the downhole motor relative to a stator assembly of the downhole motor in response to (a); and (c) measuring a rotational speed of the rotor assembly relative to a non-zero rotational speed of the stator assembly using a sensor package received in the rotor assembly such that relative rotation between accelerometers of the sensor package and a helical-shaped rotor of the rotor assembly is restricted.

17. The method of claim 16, further comprising:

(d) measuring differential fluid pressure across opposite ends of the helical-shaped rotor of the rotor assembly using the sensor package; and (e) measuring a power output of the downhole motor using the sensor package.

18. The method of claim 16, further comprising:

(d) communicating fluid upstream of the rotor assembly to a first pressure sensor of the sensor package; and (e) communicating fluid downstream of the rotor assembly through a central passage formed in the helical-shaped rotor of the rotor assembly to a second pressure sensor of the sensor package.

19. The method of claim 16, further comprising:

(d) estimating a whirl rate of the rotor assembly based on measurements provided by a plurality of accelerometers and a gyroscope of the sensor package.

* * * * *